US005176073A

United States Patent [19]

Dressel

[11] Patent Number: 5,176,073

[45] Date of Patent: Jan. 5, 1993

[54] DEWATERING PRESS

[75] Inventor: Eberhard Dressel, Meerbusch, Fed. Rep. of Germany

[73] Assignee: G. Siempelkamp GmbH & Co., Krefeld, Fed. Rep. of Germany

[21] Appl. No.: 671,871

[22] PCT Filed: Sep. 25, 1990

[86] PCT No.: PCT/DE90/00724

§ 371 Date: Apr. 5, 1991

§ 102(e) Date: Apr. 5, 1991

[87] PCT Pub. No.: WO91/05110

PCT Pub. Date: Apr. 18, 1991

[30] Foreign Application Priority Data

Sep. 26, 1989 [DE] Fed. Rep. of Germany ..... 3932098

[51] Int. Cl.[5] ..... B30B 9/06; B30B 9/24

[52] U.S. Cl. ..... 100/112; 100/118; 100/151; 100/226; 134/104.1; 210/401

[58] Field of Search ..... 100/112, 118, 151-154, 100/226, 229 R; 134/104.1; 198/495; 210/386, 391, 393, 400, 401

[56] References Cited

U.S. PATENT DOCUMENTS

| | | | |
|---|---|---|---|
| 602,620 | 4/1898 | Flory et al. | 100/112 X |
| 3,459,122 | 8/1969 | Pastoors et al. | 100/118 |
| 3,680,476 | 8/1972 | Pfeiffer | 100/118 X |
| 3,705,546 | 12/1972 | Gunkel | 100/118 |
| 3,720,159 | 3/1973 | Gunkel | 100/118 |

FOREIGN PATENT DOCUMENTS

| | | | |
|---|---|---|---|
| 1185911 | 1/1965 | Fed. Rep. of Germany . | |
| 1225851 | 9/1966 | Fed. Rep. of Germany . | |
| 2011752 | 9/1971 | Fed. Rep. of Germany | 100/118 |
| 2511787 | 9/1976 | Fed. Rep. of Germany . | |
| 3135651 | 3/1983 | Fed. Rep. of Germany . | |
| 3715827 | 12/1988 | Fed. Rep. of Germany | 210/401 |
| 56-15293 | 4/1981 | Japan | 210/401 |
| 57-79098 | 5/1982 | Japan | 100/118 |
| 1149091 | 4/1969 | United Kingdom . | |

*Primary Examiner*—Harvey C. Hornsby
*Assistant Examiner*—Stephen F. Gerrity
*Attorney, Agent, or Firm*—Herbert Dubno; Yuri Kateshov

[57] ABSTRACT

A dewatering press for a mat of solid material, particularly for dewatering of fiber panels, includes upstream and downstream spaced apart stationary uprights, a press having a lower part and an upper part pressing against the mat of solid material in a pressing position of the press and a plurality of rollers mounted on the stationary uprights and guiding respectively a grate belt and lower and upper sealing belts between the uprights.

5 Claims, 3 Drawing Sheets

DEWATERING PRESS

CROSS REFERENCE TO RELATED APPLICATIONS

This application is a national phase of PCT/DE 90/00724 filed Sep. 25, 1990 and based, in turn, upon German National Application P 3932098.1 filed Sep. 26, 1989.

FIELD OF THE INVENTION

The invention relates to a press for dewatering of a mat of solid matter consisting of goods to be pressed.

BACKGROUND OF THE INVENTION

Dewatering presses disclosed in the German Patent (DE 31 35 651) and including the return means for the lath grate band as well as the return means for the sealing band are mounted on or within a press frame. Furthermore, a means is provided for cleaning of the lath grate band. As a result, the lath grate band and the sealing band can be detached from one another outside press platens. In such the structure the cleaning means operates in the clear space and is usually designed as spray nozzles or the like. The sealing band can also be cleaned in this manner.

For the mesh band, separate cleaning means are provided along the band's recirculating path. The structure has been proven to be successful. However, the apparatus also requires an additional means for cleaning the lath grate band or the sealing band which are part of the dewatering platen press. The use of such additional means for cleaning is not economical.

OBJECTS OF THE INVENTION

It is therefore, the object of the invention to provide the dewatering press improving a cleaning in a simple and economical manner.

SUMMARY OF THE INVENTION

The press according to the invention includes an upper press section and a lower press section, a powered mesh band or sieve band guided through the dewatering press via stationary arrayed drums and receiving the mat of solid matter, an endless lath grate band running on a return means, and an endless sealing band circulating via return means and guided around the lower press section. The interstice between the laths in the lath grate band represents a drain slot through which the water, extruded during the pressing, runs off. The sealing band prevents the water to run off out of control. In order to avoid resting of the solid matter the lath grate band according to the invention is guided through a cleaning basin, which is placed below the dewatering press. The two machine frames can be made as a unitary frame. According to the invention, the cleaning means are not components of the dewatering press but a separate part of the assembly characterized by a simple structure. As a result of the basin, a very effective cleaning can be carried out in a simple manner. For this purpose, the cleaning basin can be filled with a cleaning water. One of the advantages of the present invention is the use of cleaning nozzles and/or cleaning brushes. It is also within the framework of the invention to likewise carry the sealing band through the cleaning basin providing effective cleaning of the former. Further, the mesh band can also be cleaned in the cleaning basin.

Still another advantage of the press according to the invention is the cyclical work of the dewatering press which is a dewatering platen press. It is understood that in this case the lath grate band and the sealing band, during the return motion of the opened dewatering platen press, do not experience disturbing wear effects due to the absence of contact with other machine parts. For this purpose the band may be suitably displaced within the stationary machine frame. In addition, the bands can be aligned exactly at the level of the lower platen press by means of an adjustment mechanism.

Another embodiment according to the invention shows the dewatering press realized as a continuous press operating in a sustained manner.

BRIEF DESCRIPTION OF THE DRAWING

The above and other objects, features and advantages of my invention will become more readily apparent from the following description, reference being made to the accompanying highly diagrammatic drawing in which.

SPECIFIC DESCRIPTION

Figures 1, 1A:
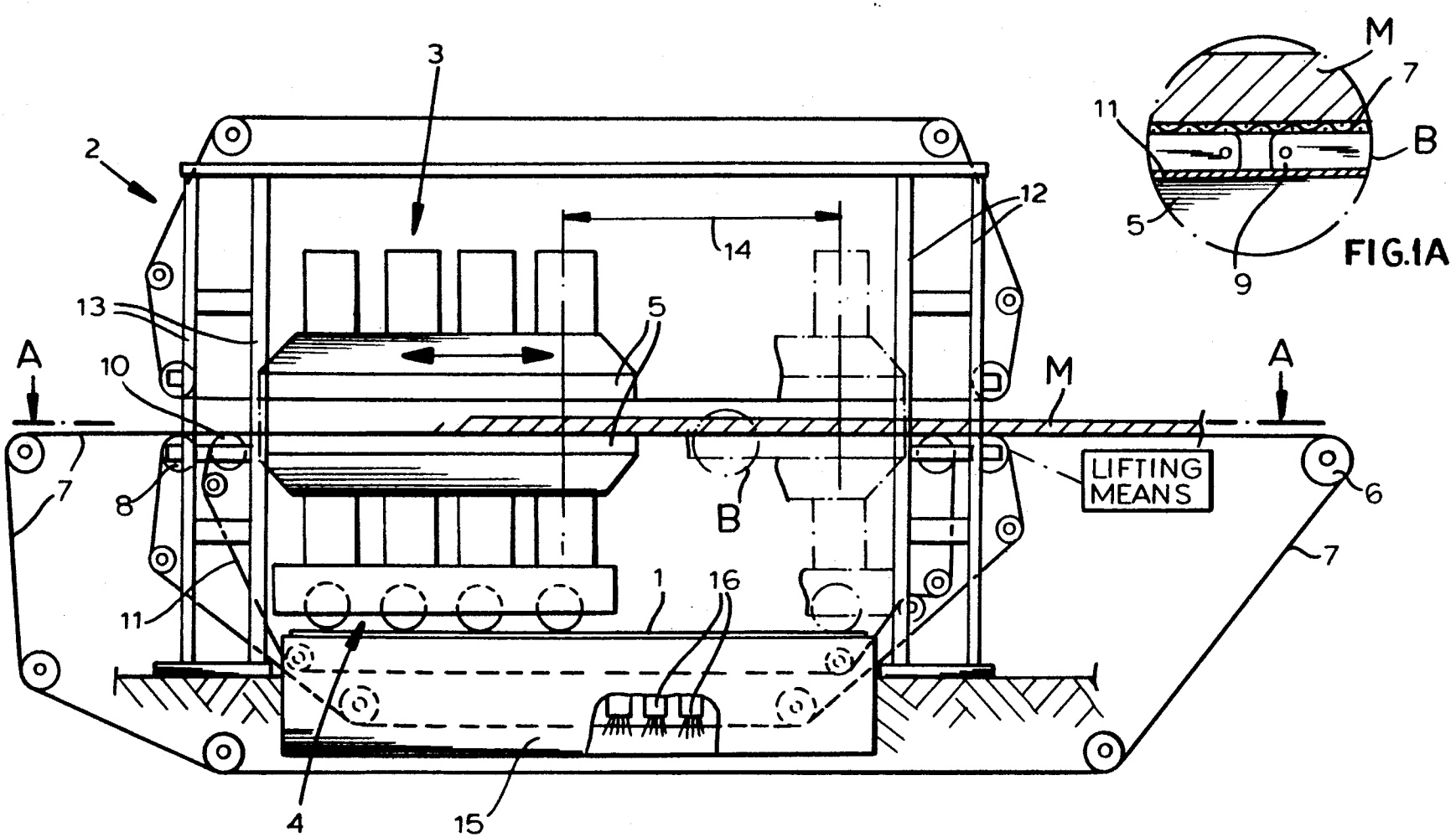
FIG. 1 is a side view of one embodiment of the press according to the invention.
FIG. 1*a* is an enlarged cross sectional view of the detail B according to FIG. 1.
Figure 2:
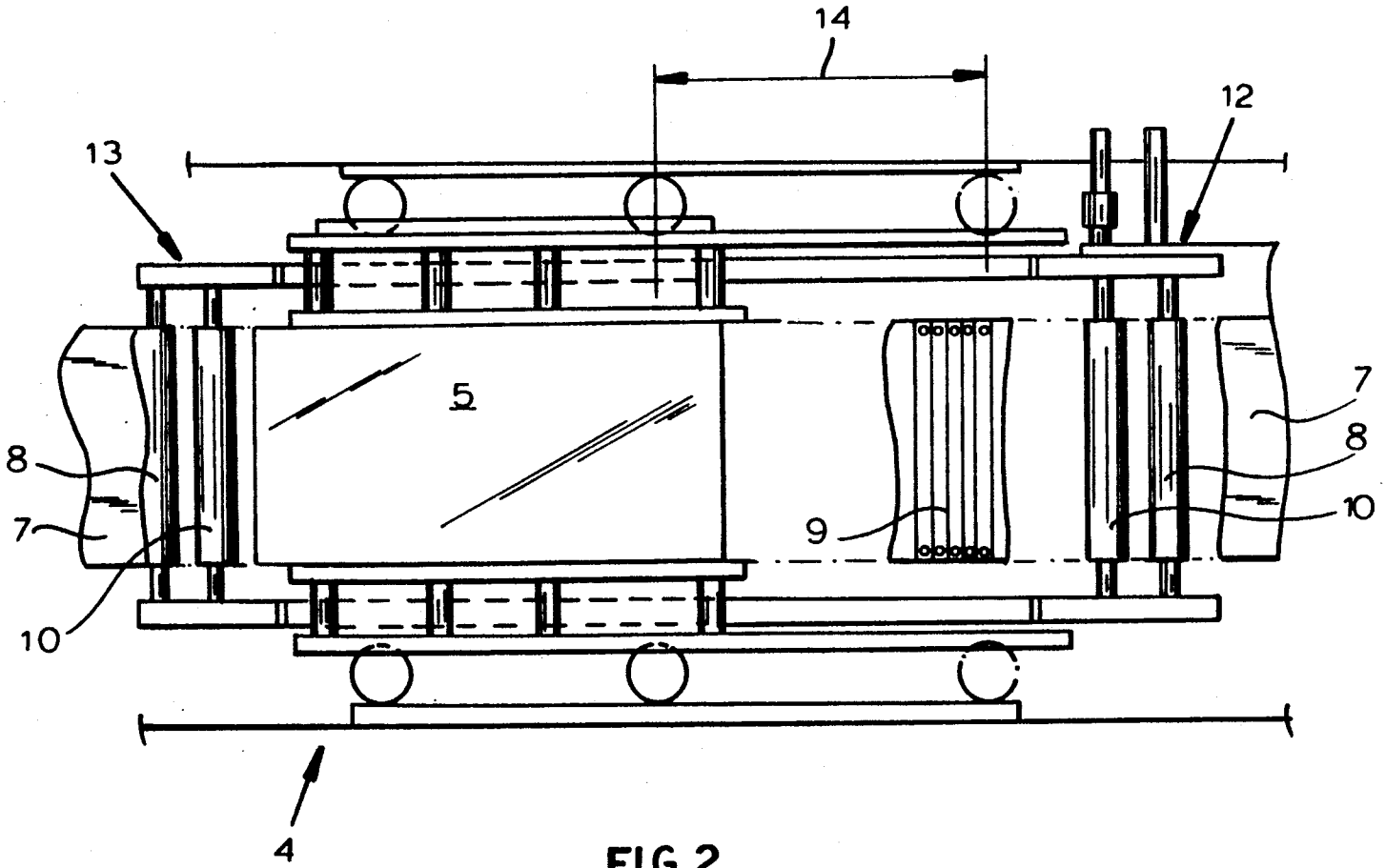
FIG. 2 is a sectional view of the press illustrated in FIG. 1 along lines A—A.
Figure 3A:
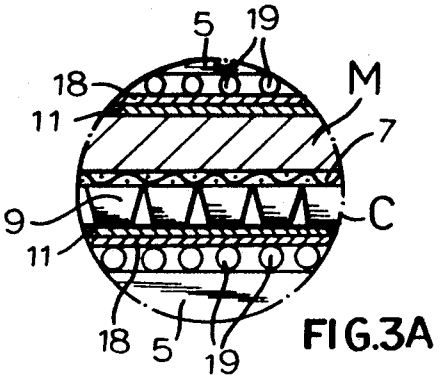
FIG. 3*a* is an enlarged cross sectional view of the detail C according to FIG. 3.
Figure 3:
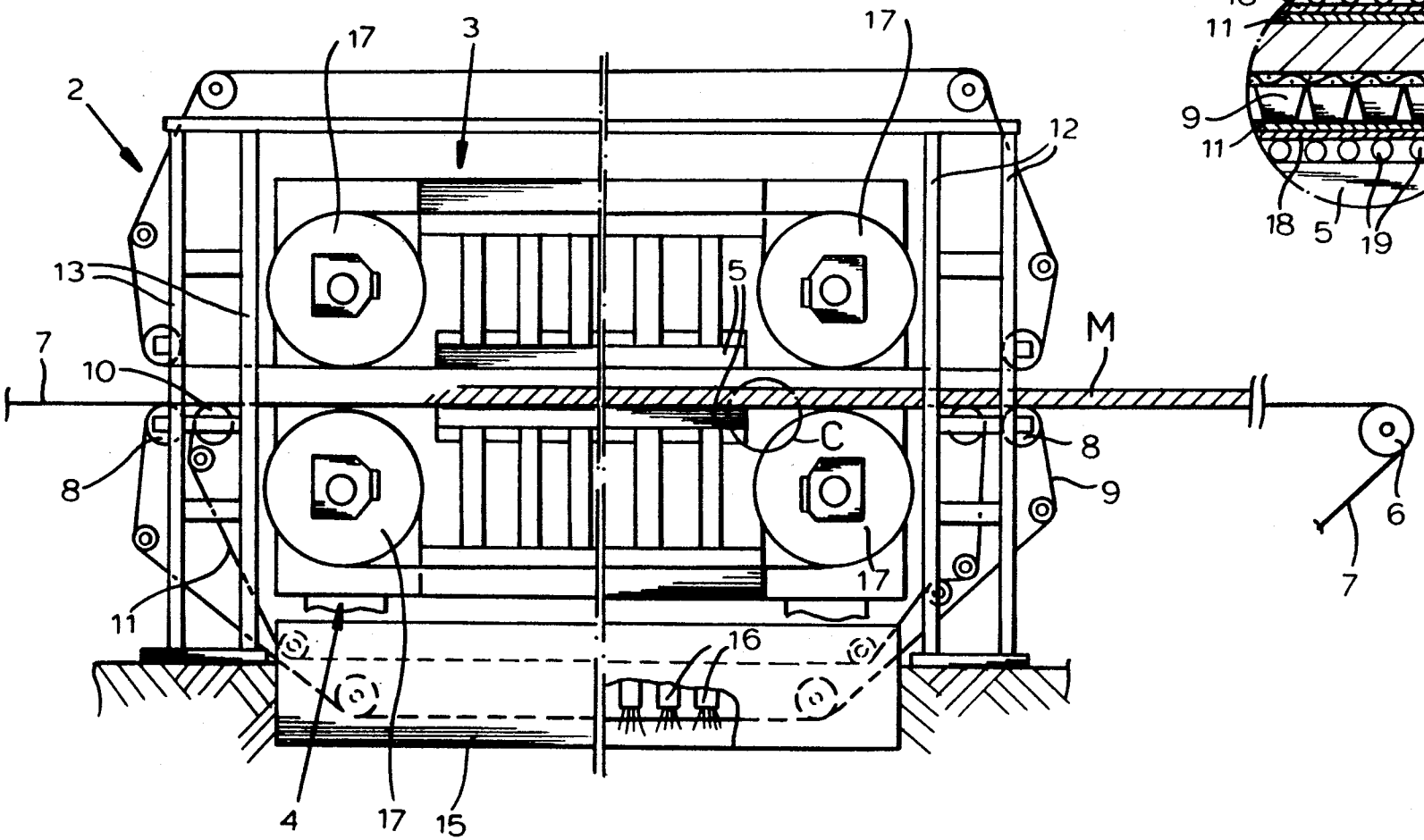
FIG. 3 is a side view partly in vertical section of another embodiment of the press according to the invention.

The embodiments shown in FIGS. 1-3 serve for the dewatering of a mat of solid matter M wetted with a water during manufacturing of panels of solid matter, particularly fiber panels, by pressing the mat between upper and lower press sections.

With respect to the pressing process, the arrangement shown in FIGS. 1 and 2 operates cyclically. A dewatering platen press 2 moves back and forth along a process section upon rails 1 and has an upper press section 3 and a lower press section 4 as well as upper and lower press platens 5. A powered perforated mesh band 7 accepting the solid matter mat M is guided through the dewatering platen press 2 and over stationary return drums 6. This perforated band 7 may be strewn with the press material to the left beyond the FIG. and passes a watering station for the press material, which was not drawn. An endless lath grate band 9 runs around the lower press section 4 via guiding means 8 and circulates between mesh band 7 and lower press platen 5. Thereto, a reference is made to the enlarged detail B in FIG. 1. An endless sealing band 11 runs between lath grate band 9 and lower press platen 5. The arrangement operates in such a manner that the scattering means which covers the mesh band 7 with the fiber mass works continuously. Consequently, the arrangement is furthermore so constituted that, during the pressing process, the dewatering platen press is movable depending on the transportation speed of the mesh band 7, and subsequently is capable of being moved in the open condition for pressing of the subsequent portion. This is illustrated by a double arrow in the upper press section of FIG. 1.

FIG. 1 shows the return means 8 for the lath grid band 9 as well as the return means 10 for the sealing band 11 which are journaled in the stationary machine frames 12, 13 and which are arranged ahead of and behind the oscillatory section of the dewatering platen press 2. The lath grate band 9 is guided through a cleaning basin 15 which is mounted below the running rails 1 of the dewatering platen press 2. The cleaning basin 15 is filled with a cleaning water and can have additional cleaning means 16, for example, cleaning nozzles and/or cleaning brushes, which are shown in FIG. 1. In the embodiment the sealing band 11 is also guided through the cleaning basin 15. It is understood that if required, the perforated band 7 can also be run through the cleaning basin as shown in FIG. 1. The lath grate 9 is capable of being lifted up by a respective lifting means shown in FIG. 1, so that during the return motion of the dewatering platen press there is no deleterious wear due to the absence of contact with other machine parts. The same applies to the sealing band 11. With an appropriate means, the bands 9, 11 are also adjustable to the level of the lower press platen 5.

With respect to the pressing process, the arrangement according to FIG. 3 operates continuously. The dewatering press 2 thereby is a continuously operating press. In press upper section 3 as well as in lower press section 4 endless powered steel bands 18 are guided via return drums 17. The enlarged detail C in FIG. 2A demonstrates the sealing band 11, the lath grate band 9 and the mesh band 7 guided towards the solid material mat M on steel band 18. The steel bands 18 are supported on the respective press platens 5 by means of rollers 19.

I claim:

1. A dewatering press assembly for dewatering a mat of a solid material, said press assembly comprising:

means for guiding an endless mesh belt receiving a mat of a solid material along a path;

an upstream stationary upright and a downstream stationary upright spaced from said upstream upright along said path;

a dewatering press along said path between said uprights, said press including:

a lower platen on one side of said mesh belt, and an upper platen on an opposite side of said mesh belt, one of said platens being movable toward the other platen in a pressing position corresponding to the dewatering of the mat and back to an open position of said press;

means for displacing said press back and forth along said path between said uprights;

transport means on said uprights for moving an endless grate belt along said path between said uprights, said grate belt being juxtaposed between said mesh belt and said lower platen;

first conveying means on said uprights for transporting an endless lower sealing belt sandwiched between said lower platen and said grate belt, said grate and sealing belts having respective lower stretches spaced downwardly from said lower platen between said uprights;

second conveying means for guiding an upper endless sealing belt between said upper platen and said mat; and cleaning means for cleaning said lower stretch of said grate belt, said cleaning means including a cleaning basin formed between said uprights and spaced downwardly from said lower platen.

2. The dewatering press defined in claim 1 wherein said mesh belt has a lower stretch, said lower stretches of said mesh and sealing belts being guided through said cleaning basin.

3. The dewatering press defined in claim 1, further comprising:

rails on said cleaning basin for guiding said press reciprocatingly between said uprights; and elevating means for elevating said grate and lower sealing belt from said lower platen in said open position of the press upon guiding thereof upstream along said path.

4. The dewatering press defined in claim 1 wherein said cleaning means further includes a plurality of cleaning nozzles and cleaning brushes mounted in said basin.

5. The dewatering press defined in claim 1 wherein said basin is filled with cleaning water.

* * * * *